US007493693B2

(12) United States Patent
Li

(10) Patent No.: US 7,493,693 B2
(45) **Date of Patent: *Feb. 24, 2009**

(54) METHOD FOR FABRICATING MULTI-LAYER WICK STRUCTURE OF HEAT PIPE

(76) Inventor: Jia-Hao Li, No. 2, Lane 127, Dang Ke St., Kang Shan Jen, Kao Hsiung Hsien (TW)

( * ) Notice: Subject to any disclaimer, the term of this patent is extended or adjusted under 35 U.S.C. 154(b) by 662 days.

This patent is subject to a terminal disclaimer.

(21) Appl. No.: 11/022,670

(22) Filed: Dec. 28, 2004

(65) Prior Publication Data

US 2006/0137182 A1 Jun. 29, 2006

(51) Int. Cl.

| | |
|---|---|
| ***B21D 39/03*** | (2006.01) |
| ***B23P 6/00*** | (2006.01) |
| ***F28D 15/00*** | (2006.01) |
| ***H01B 7/42*** | (2006.01) |
| ***H05K 7/20*** | (2006.01) |

(52) U.S. Cl. ..... 29/890.032; 29/428; 165/104.11; 165/104.22; 165/104.26; 165/104.33; 174/15.2; 257/E23.088; 361/700

(58) Field of Classification Search ..... 29/890.032, 29/428; 165/104.11, 104.22, 104.26, 104.33; 361/700, 704; 174/15.2; 257/E23.088
See application file for complete search history.

(56) References Cited

U.S. PATENT DOCUMENTS

| | | | | |
|---|---|---|---|---|
| 4,557,413 | A * | 12/1985 | Lewis et al. | 228/183 |
| 6,446,706 | B1 * | 9/2002 | Rosenfeld et al. | 165/46 |
| 6,460,612 | B1 * | 10/2002 | Sehmbey et al. | 165/96 |
| 6,619,384 | B2 * | 9/2003 | Moon et al. | 165/104.26 |
| 6,983,791 | B2 * | 1/2006 | Hsu | 165/104.26 |
| 7,140,421 | B2 * | 11/2006 | Hsu | 165/104.26 |
| 7,143,817 | B2 * | 12/2006 | Li | 165/104.26 |
| 2006/0213061 | A1 * | 9/2006 | Wu et al. | 29/890.032 |

* cited by examiner

*Primary Examiner*—David P Bryant
*Assistant Examiner*—Alexander P Taousakis

(57) ABSTRACT

A method for fabricating a multi-layer wick structure of a heat pipe includes providing a first and a second weaving meshes, overlaying and winding the first and the second weaving meshes to form an open circular structure with the first weaving mesh encircling the second weaving mesh, inserting the open circular structure into a tubular member of the heat pipe, pressing the tubular member towards an central axis thereof such that the open circuit structure is forced into a close circular wick structure, and melting the first waving mesh to be attached on an interior surface of the tubular member.

2 Claims, 6 Drawing Sheets

METHOD FOR FABRICATING MULTI-LAYER WICK STRUCTURE OF HEAT PIPE

BACKGROUND OF THE INVENTION

The present invention relates in general to a method for fabricating multi-layer wick structure of a heat pipe, and more particularly, to a method for fabricating a multi-layer wick structure to be easily inserted into a heat pipe and can be firmly attached to a tubular member of the heat pipe under a shrinking process.

The heat pipe has been applied in various types of electronic products for delivering large amount of heat without consuming significant power because of the characteristics of high thermal transmission capacity, high thermal transmission speed, high thermal conduction efficiency, light weight, none mobile element, simple structure and versatile applications. The conventional heat pipe includes a wick structure attached to an interior surface of a heat-pipe body. The wick structure includes weaving mesh that has capillary effect, such that a working fluid filled in the heat-pipe body can be used to deliver heat. To improve the capillary force and the amount of heat to be transferred by the wick structure, multi-layer structure has been adapted in the heat pipe.

FIG. 1 shows a conventional weaving mesh of a wick structure 1*a* which is curled into a multi-layer structure. When the curled wick structure 1*a* is inserted into the heat pipe body 2*a*, a sintering process is required to attach the curled wick structure 1*a* to the internal surface of the heat pipe body 2*a*. However, as the weaving mesh of the wick structure 1*a* is typically too soft to support itself. The multi-layer portion A formed by curling process makes the attachment worse. As there provides no additional support structure, the wick structure 1*a* is easily softened and collapsed due to the heat generated in the high-temperature sintering process.

BRIEF SUMMARY OF THE INVENTION

To resolve the above drawbacks, a method for fabricating a multi-layer wick structure of a heat pipe is provided. By shrinking the tubular member of the heat pipe, the weaving meshes of each layer of the wick structure can be attached to an interior surface of the tubular member.

Accordingly, the method for fabricating a wick structure of a heat pipe includes providing a first and a second weaving meshes wherein the first weaving mesh is larger than the second weaving mesh, winding the first weaving mesh to form an open circular structure with the second weaving mesh formed on an outer local area of the open circular structure, inserting the open circular structure into a tubular member of the heat pipe, pressing the tubular member towards an central axis thereof such that the open circuit structure is forced into a close circular wick structure, and melting the first and the second waving mesh to be attached on an interior surface of the tubular member.

The objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The above objects and advantages of the present invention will be become more apparent by describing in detail exemplary embodiments thereof with reference to the attached drawings in which.

DETAILED DESCRIPTION OF THE INVENTION

Figure 1:
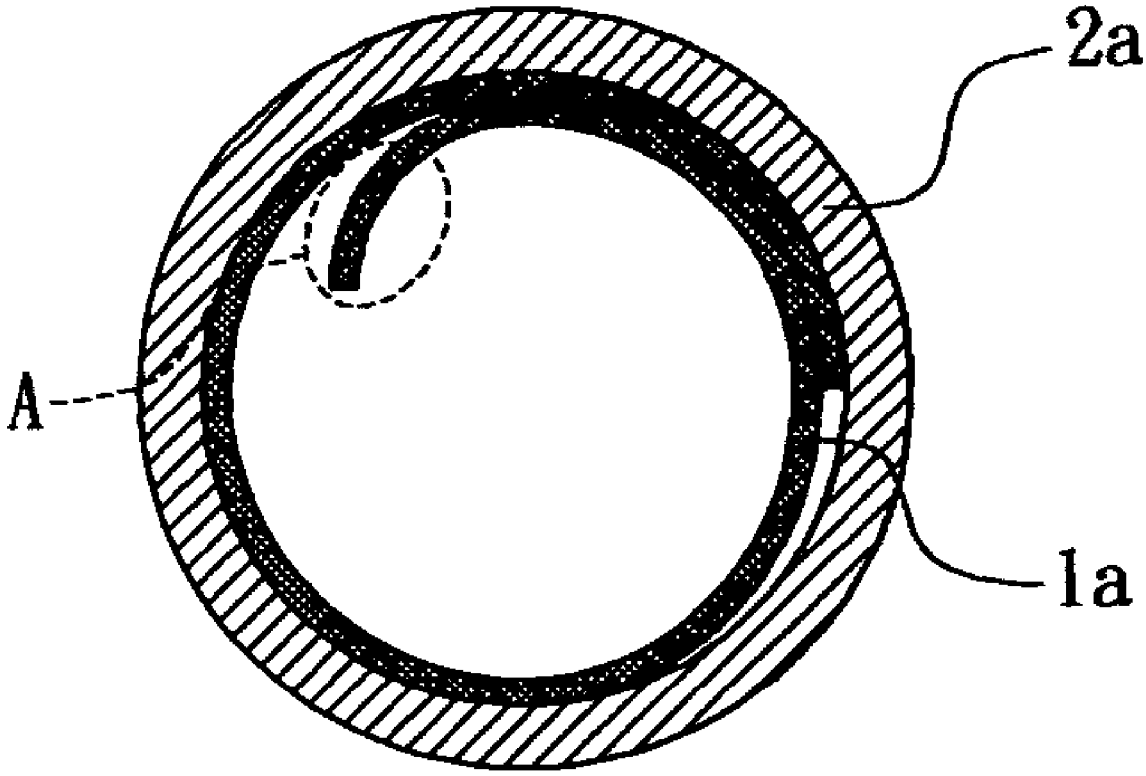
FIG. 1 PRIOR ART
FIG. 1 shows an a cross sectional view of a conventional heat pipe.

Reference will now be made in detail to the preferred embodiments of the present invention, examples of which are illustrated in the accompanying drawings. Wherever possible, the same reference numbers are used in the drawings and the description to refer to the same or like parts.

Referring to FIGS. 2-6, a multi-layer wick structure of a heat pipe is provided. The wick structure is attached to the interior surface of a tubular member by a shrinking process performed to the tubular member.

Figure 2:
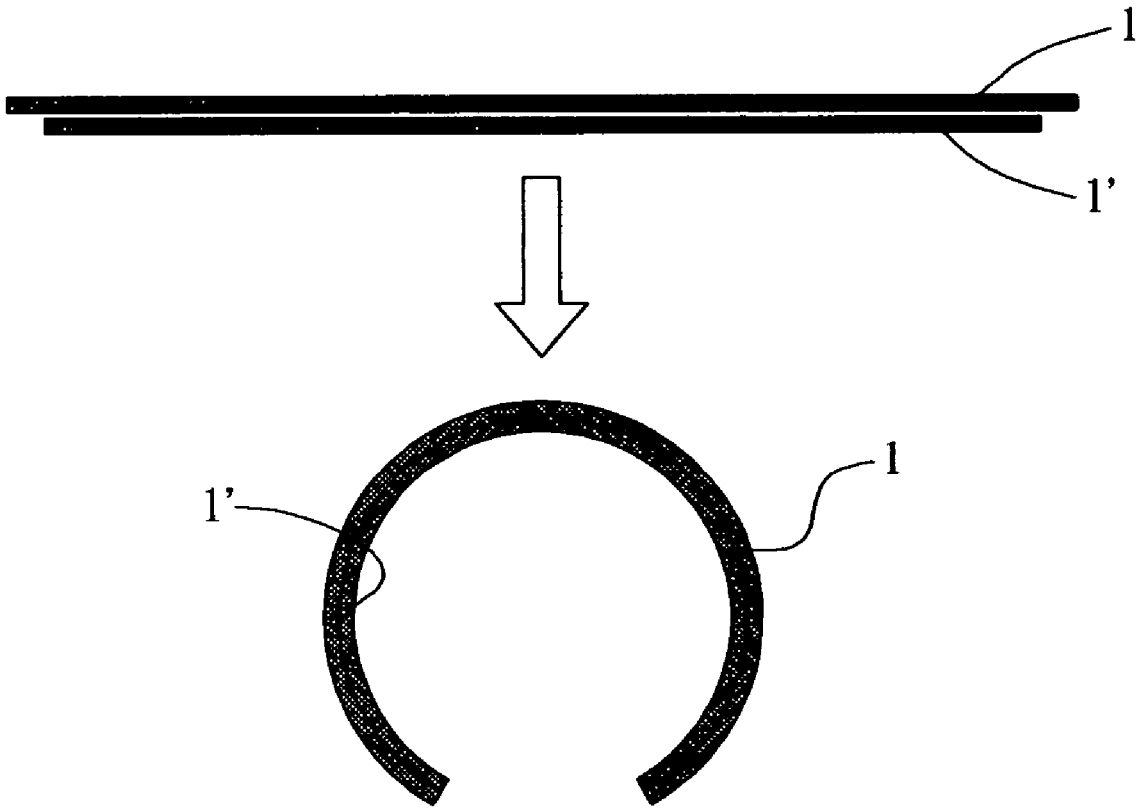
FIG. 2 shows the process of winding a multi-layer wick structure.
Figure 3:
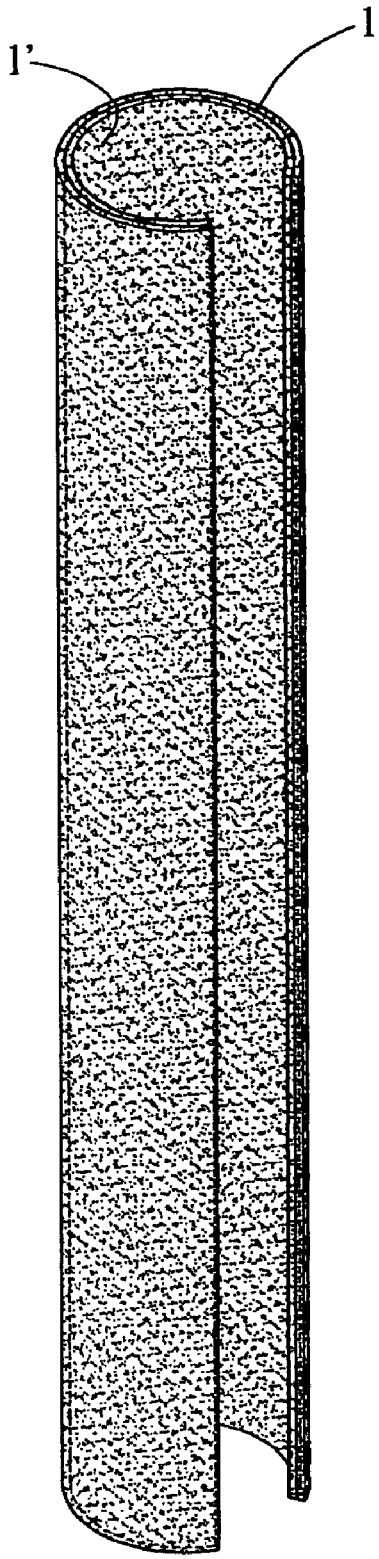
FIG. 3 shows the open circular profile of the winded multi-layer wick structure.

As shown in FIGS. 2 and 3, the wick structure has an outer layer and an inner layer of weaving meshes 1 and 1' overlaying each other. As shown in FIGS. 2 and 3, the wick structure is winded into an open circle with the layer of weaving mesh 1 encircling the layer of weaving mesh 1'. Therefore, the outer layer 1 is preferably longer than the inner layer 1'.

Figure 4:
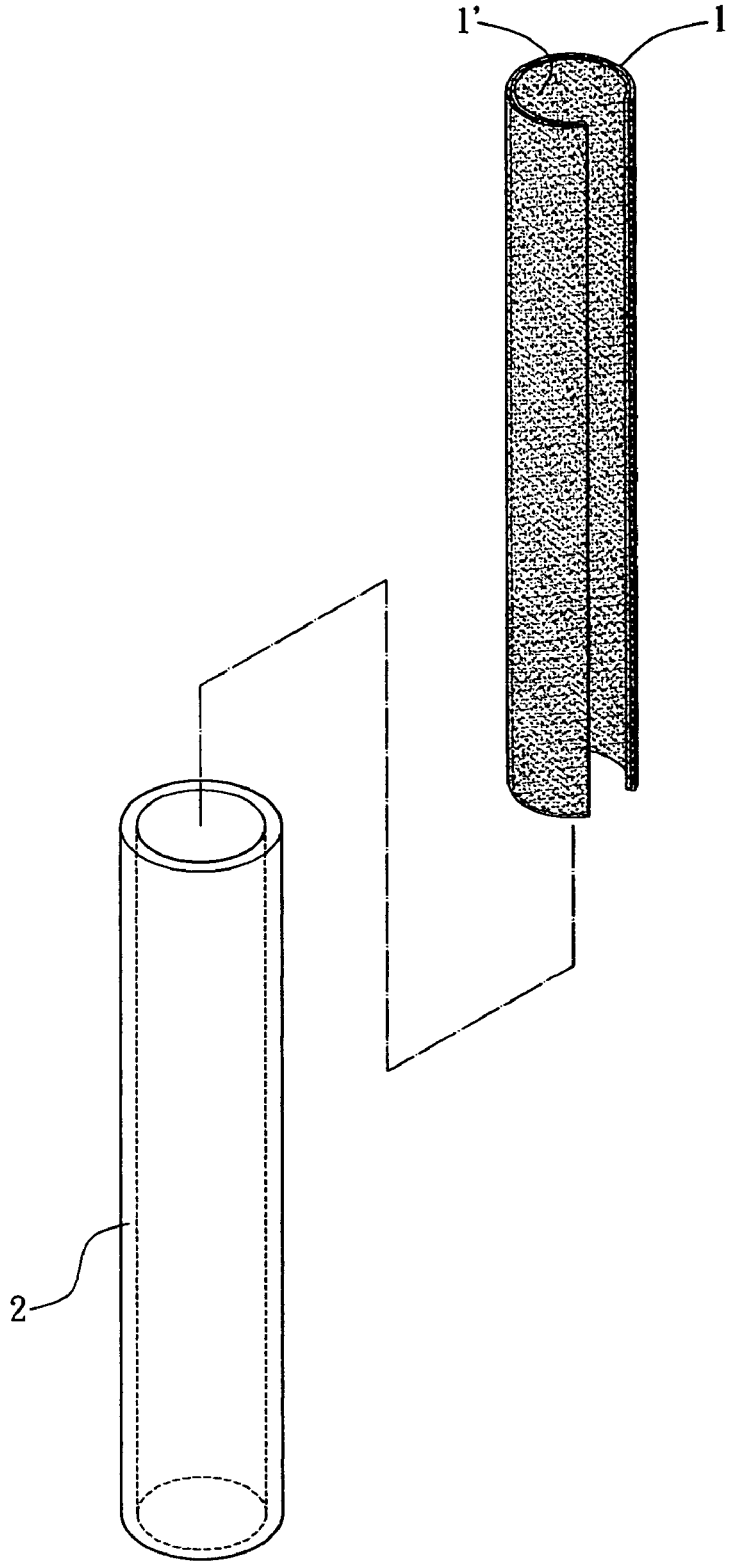
FIG. 4 shows the process for inserting the wick structure into a tubular member of a heat pipe.
Figure 5:
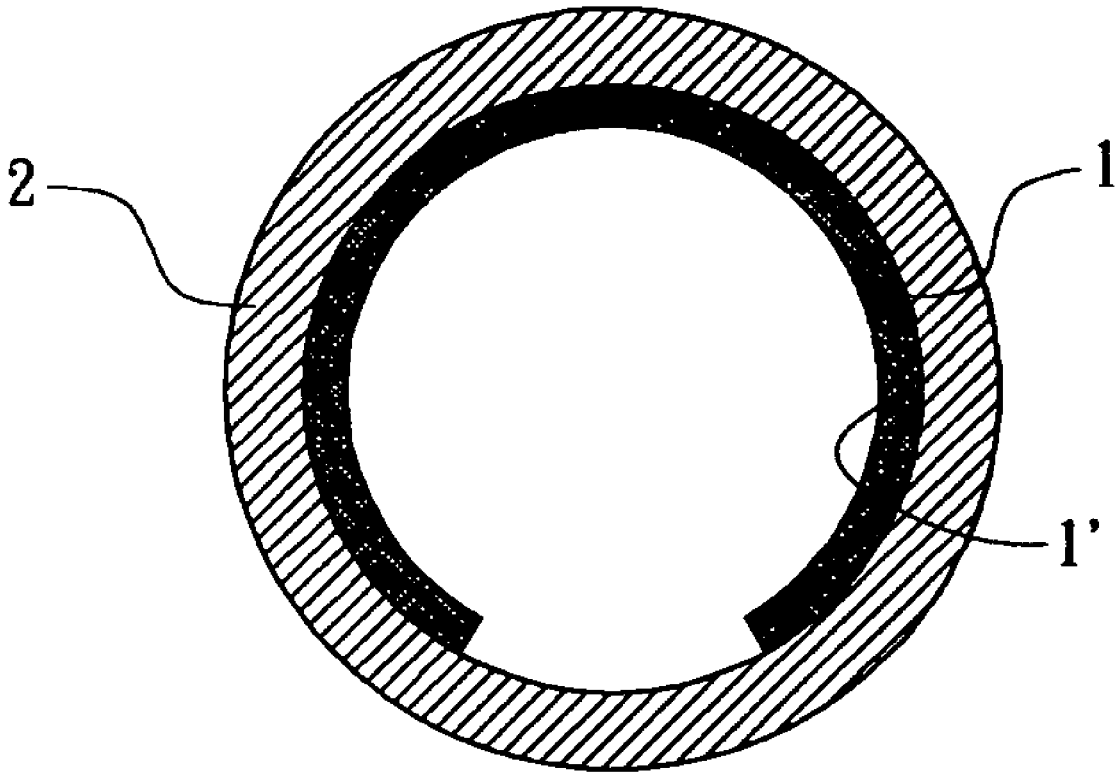
FIG. 5 shows the cross sectional view of the heat pipe before the tubular member is shrunk.

As shown in FIG. 4, a tubular member 2 is provided. Preferably, the tubular member 2 has an internal diameter no less than the exterior diameter of the open circle formed of the layers of weaving meshes 1 and 1', such that the layers of weaving meshes 1 and 1' can be easily inserted into the tubular member 2. A cross sectional view of the tubular member 2 and the wick structure formed of the winded layers of weaving meshes 1 and 1' is shown in FIG. 5.

Figure 6:
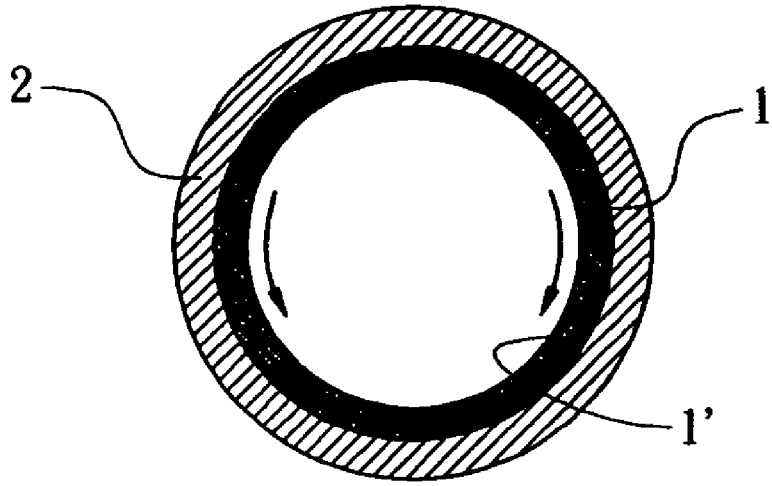
FIG. 6 shows the cross sectional view of the end-product of the heat pipe.

In FIG. 6, a shrinking process is performed to the tubular member 2. As shown, an external force is applied to press the tubular member 2 inwardly. Thereby, the diameter of the tubular member 2 is reduced, and the open circle made by the layers of weaving meshes 1 and 1' is closed and firmly attached to the interior surface of the tubular member as shown. Thereby, a sintering process is not required for attaching the wick structure to the tubular member 2, such that the wick structure will not be peeled from the tubular member in the subsequent annealing process.

Figure 7:
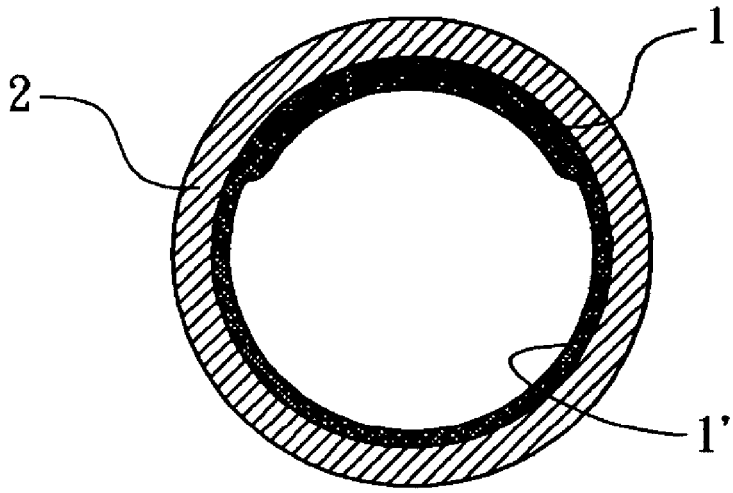
FIG. 7 shows the cross sectional view of another end-product of the heat pipe.

In FIG. 7, another preferred embodiment of the multi-layer wick structure is shown. Only the inner layer of weaving mesh 1' is winded into a circle and the outer layer of weaving mesh 1 is formed on the local area of the inner layer 1' to be attached on a predetermined location of the interior surface of the tubular member 2. As such, the outer layer 1 can be used to increases the capillary ability of the heat pipe at the predetermined location.

By the above process, the wick structure does not need to be curled into a close circle before being inserted into the tubular member 2. The insertion is thus easier. By the shrinking process of the tubular member 2, the wick structure can be easily attached to the interior surface thereof. During the high-temperature annealing process, the inner layer 1' can provide sufficient support to the outer layer 1 when the outer layer 1 starts melting at the operation temperature, such that the weaving mesh of the outer layer 1 is not easily softened and peeled from the interior surface of the tubular member 2.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. A method for fabricating a wick structure of a heat pipe, comprising:

providing a first and a second weaving meshes, wherein the first weaving mesh is longer than the second weaving mesh;

overlaying and winding the first and the second weaving meshes to form an open circular structure with the first weaving mesh encircling the second weaving mesh;

inserting the open circular structure into a tubular member of the heat pipe;

pressing the tubular member towards an central axis thereof such that the open circuit structure is forced into a close circular wick structure; and melting the first waving mesh to be attached on an interior surface of the tubular member.

2. A method of fabricating a wick structure of a heat pipe, comprising:

providing a first and a second weaving meshes, wherein the first weaving mesh is larger than the second weaving mesh;

winding the first weaving mesh to form an open circular structure with the second weaving mesh formed on an outer local area of the open circular structure;

inserting the open circular structure into a tubular member of the heat pipe;

pressing the tubular member towards an central axis thereof such that the open circuit structure is forced into a close circular wick structure; and melting the first and the second waving mesh to be attached on an interior surface of the tubular member.

* * * * *